US005778809A

United States Patent [19]

Schips

[11] Patent Number: 5,778,809

[45] Date of Patent: Jul. 14, 1998

[54] DEVICE FOR AUTOMATICALLY CUTTING OFF THREAD FORMATIONS IN SEWING MACHINES

[75] Inventor: Helmut Schips, St. Gallen, Switzerland

[73] Assignee: SCHIPS AG Naehautomation, Tuebach, Switzerland

[21] Appl. No.: 678,195

[22] Filed: Jul. 11, 1996

[30] Foreign Application Priority Data

Jul. 14, 1995 [DE] Germany ..... 295 11 402.9

[51] Int. Cl.[6] ..... D05B 65/00

[52] U.S. Cl. ..... 112/287; 112/291

[58] Field of Search ..... 112/287, 285, 112/288, 291, 293, 296, 299, 300, 301

[56] References Cited

U.S. PATENT DOCUMENTS

| | | | |
|---|---|---|---|
| 1,537,155 | 5/1925 | Allen . | |
| 3,690,276 | 9/1972 | King et al. | 112/288 X |
| 3,712,256 | 1/1973 | Striegler et al. | 112/288 |
| 3,922,983 | 12/1975 | Schips et al. | 112/288 |
| 3,994,249 | 11/1976 | Hsiao | 112/285 |

FOREIGN PATENT DOCUMENTS

| | | |
|---|---|---|
| 1 660 829 | 3/1971 | Germany . |
| 1 945 310 | 4/1971 | Germany . |
| 1 685 040 | 7/1971 | Germany . |
| 564 629 | 7/1975 | Switzerland . |

*Primary Examiner*—Paul C. Lewis
*Attorney, Agent, or Firm*—Spencer & Frank

[57] ABSTRACT

An apparatus for automatically cutting off thread formations in sewing machines having a longitudinal direction and a transverse direction. The apparatus includes: a needle plate having a surface defining a support plane; a transport plate disposed adjacent the needle plate, the transport plate being displaceable in a plane parallel to the support plane in both the longitudinal direction and the transverse direction; a cutting device disposed adjacent the needle plate for cutting off a thread formation from the sewn item, the cutting device including a stationary lower blade connected to the needle plate and an upper blade connected to the transport plate, the upper blade defining a first recess therein; and a hold-down device disposed adjacent the needle plate and defining a second recess therein and being configured for holding down a sewn item on the needle plate.

10 Claims, 4 Drawing Sheets

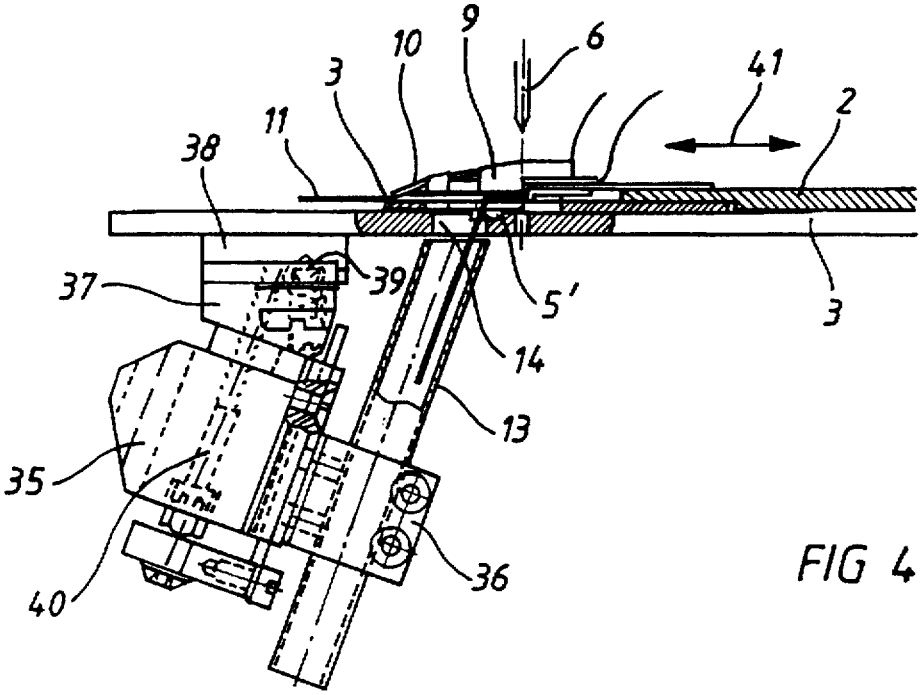
FIG 4
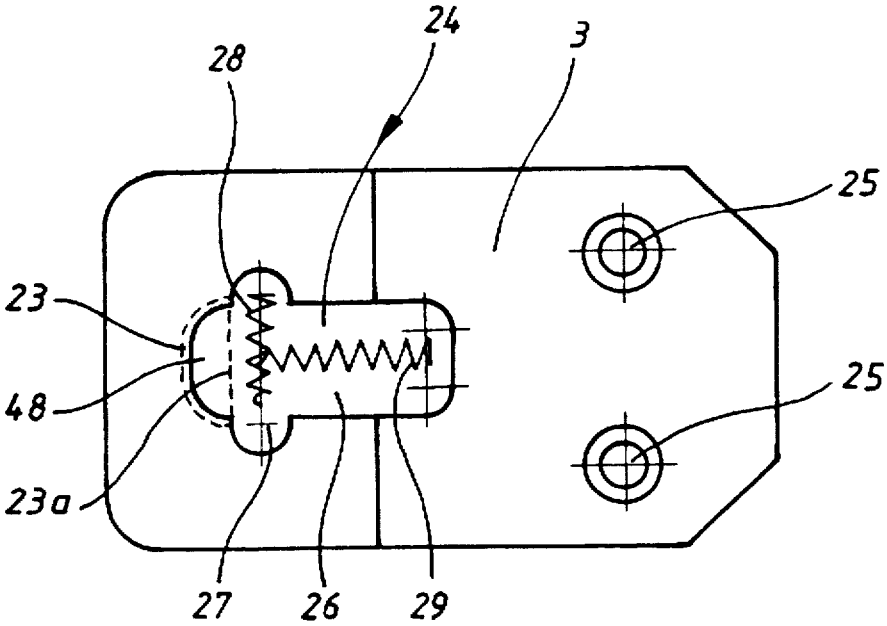
FIG 5
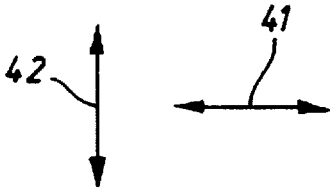

DEVICE FOR AUTOMATICALLY CUTTING OFF THREAD FORMATIONS IN SEWING MACHINES

FIELD OF THE INVENTION

The invention relates to an arrangement for automatically cutting off thread formations in sewing machines, the arrangement including a needle plate, a transport plate, a hold-down device and a cutting device.

BACKGROUND OF THE INVENTION

It is known that, when so-called thread chains are taken up, particularly in tricot items, the thread chain is separated by machine and by hand. A technical teaching of this nature is known from CH 564 629 by the same applicant. In this known apparatus, the cutting arrangement comprises a displaceably-driven upper blade whose cutting edge cooperates with a stationary lower blade; the thread chain is inserted between the two parts, and is received in a suction pipe below through a recess in the needle plate.

In CH 564 629, however, it was only possible to apply longitudinal bar tacks to the tricot item. This known sewing machine had only one feed direction, and therefore, as dictated by its construction, could only apply so-called longitudinal bar tacks.

SUMMARY OF THE INVENTION

Consequently, the recess in the upper blade was also only configured correspondingly as an oblong slot oriented in the longitudinal direction, which only permitted the application of longitudinal bar tacks.

It is therefore the object of the invention to refine an apparatus for automatically cutting off thread formations in sewing machines such that not only thread formations with longitudinal bar tacks, but also thread formations with other bar shapes can be sewn and cut off.

To accomplish this object, an essential feature of the invention is that the transport plate is no longer driven only in the X direction (i.e., in the feed direction of the sewn item), but is also displaceably driven in the Y direction, so that a two-dimensional drive of the transport plate is provided in accordance with the invention.

As a result, a correspondingly configured recess is provided in the upper blade, which is fixedly connected to the transport plate, and a recess is additionally provided in the hold-down device, so that the stationary sewing needle can apply the bar tack having the desired shape to the sewn item through the recess in the hold-down device and the upper blade.

With the existing technical teaching, according to the present invention the significant advantage is attained that practically any thread formations with bar tacks can be applied to the sewn item and, accordingly, the sewing threads hanging from the item can be cut off.

To this end, it is provided that the cutting edge of the upper blade is disposed in the region of the recess, in the transport direction of the sewn item, the blade being offset diagonally to the rear and downward and located opposite the cutting edge of the stationary lower blade.

It is consequently provided that the shape of the cutting edge of the upper blade is adapted to the shape of the recess when seen from the front in the sewing direction.

In other words, the cutting edge of the sewing blade limits the recess in the upper blade toward the front in the sewing direction.

In a preferred embodiment of the invention, it is provided that the recess in the upper blade and consequently the recess in the hold-down device are approximately T-shaped, with the base leg of the T-profile extending in the transport direction of the sewn item and the two T-legs extending transversely thereto.

In another embodiment of the invention, it is provided that this recess is approximately rectangular or trapezoidal, and in a third embodiment it is provided that the recess is approximately round, elliptical or oval-shaped.

A significant feature of all of the embodiments is that the recess in the upper blade approximately corresponds to the recess in the hold-down device, so the two recesses essentially cover one another. This is necessary to achieve the seam construction image, because the needle must pass through both recesses in order to reach the sewn item located beneath them.

In a preferred embodiment of the invention, it is provided that the hold-down device comprises a total of two hold-down elements disposed in mirror symmetry with respect to one another, of which each hold-down element has a foot part in the region of which one half of the above-described recess is disposed.

The advantage attained with a T-shaped recess is that both longitudinal bar tacks as well as crossbars, or combinations of these two types of bar tacks, can be applied to the sewn item.

Accordingly, other types of bar tacks can be applied—corresponding to the shaping of the recesses—such as triangular bar tacks, zig-zagging bar tacks that extend transversely to the direction of the sewn item, approximately round or oval-shaped T-bar tacks and other bar tack shapes.

A crucial feature of the invention, therefore, is that the transport plate is displaceably driven in the X and Y directions, respectively, preferably with a sliding carriage drive. This type of sliding carriage permits arbitrary displacement of the transport plate in the X-Y direction, in which instance associated stepping motors that operate in both directions perform the respectively desired displacement.

Other drive members can also be used instead of the drive utilizing stepping motors, such as toothed belt drives, cable pull drives, spindle drives or the like. It can also be provided that the transport plate is driven in the X-Y direction by means of corresponding cam plates.

Therefore, instead of the above-described, electronically-controlled bar tack machine, the present invention also encompasses mechanically-driven bar tack machines.

In accordance with the invention, it is provided that the transport plate, which can be displaced in both spatial directions, is fixedly connected to the upper blade. The lower blade is stationarily connected to the stationary needle plate; it is a prerequisite that the needle does not perform any spatial movement, but merely a vertical up-and-down movement.

The sewn item is therefore moved in the X-Y direction along with the transport sliding carriage, and it is consequently now possible—due to the recess 24 in the upper blade according to the invention (FIG. 5)—to apply arbitrary sewing material bar tacks into the sewn good without experiencing any limitations caused by the cutting device.

The subject of the present invention ensues not only from the subject of the individual features described above, but also from the combination of those features.

All information and features disclosed herein, and particularly the spatial configuration illustrated in the drawings, are claimed as essential to the invention insofar as they are novel, individually or in combination, over the prior art.

BRIEF DESCRIPTION OF THE DRAWINGS

The invention is described below in conjunction with drawings that illustrate a single embodiment. Further features and advantages that are essential to the invention ensue from the drawings and the description thereof.

Shown are in:

FIG. 4: a section according to FIG. 1, prior to cutting, FIG. 5: a plan view of the upper blade.

DETAILED DESCRIPTION OF THE INVENTION

Figure 1:
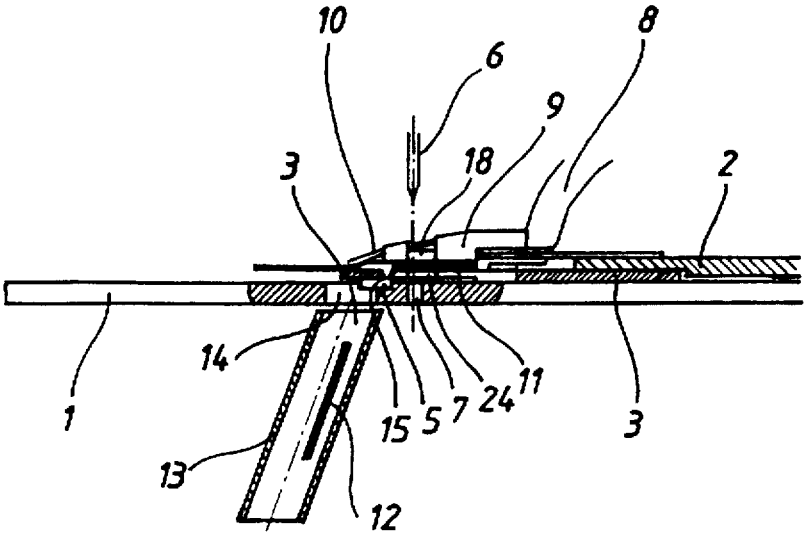
FIG. 1: a section through the sewing part of a sewing machine, in the cutting position.

According to FIG. 1, the sewing device of the sewing machine essentially comprises a stationary needle plate 1, on which a transport plate 2 is driven to be displaceable in the X-Y direction, that is, in the longitudinal and transverse directions of the device which correspond to directions perpendicular and parallel to the feeding direction of an item to be sewn, respectively (arrow directions 41, 42 in FIG. 5). The needle plate 1 is secured to the machine body of the sewing machine with screws 19.

The upper blade 3 is fixedly connected to the transport plate 2 with fastening elements 25; at the same time, a sewn item stop 20, which forms an edge 21 for the sewn item 11 that extends in a direction transverse to the sewing direction, is connected to the fastening elements 25.

Figure 2:
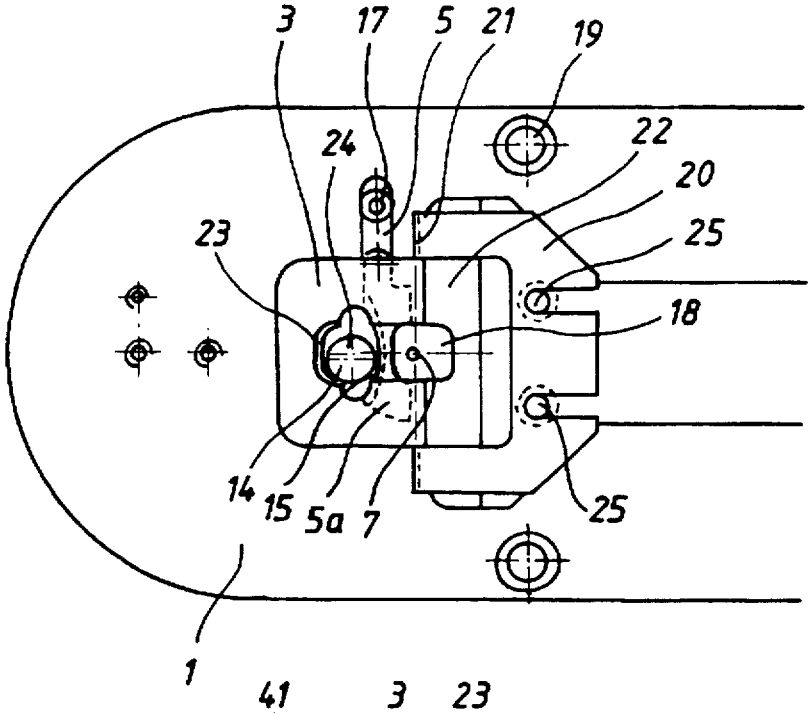
FIG. 2: a plan view of the arrangement according to FIG. 1, omitting the hold-down device, in the uncut state.

A stationary, lower blade 5 is associated with the upper blade 3; according to FIG. 2, this lower blade extends, as a narrow part, essentially in a direction transverse to the sewing direction, and is fixedly connected to the needle plate 1 by way of the screws 17.

According to FIG. 2, the lower blade 5 extends, with a slightly rounded part 5*a*, below the transport plate 2 in the transverse direction (arrow direction 42), and has a rounded cutting edge 15.

Figure 9:
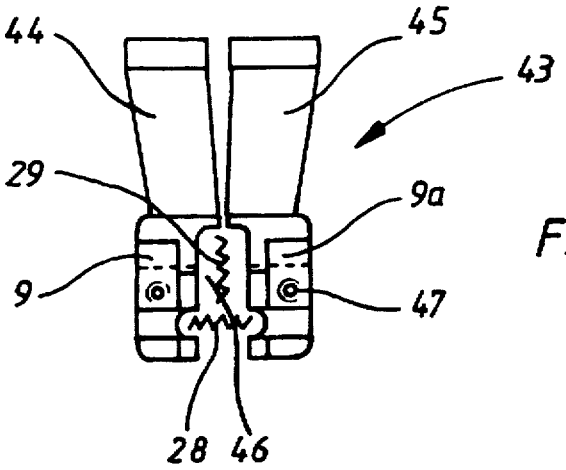
FIG. 9: a plan view of the hold-down arrangement.

The needle 6 is displaceably driven in the vertical direction, and extends through a recess 46 in the hold-down device 43 according to FIG. 9. The needle plate 1 is correspondingly provided with a needle opening 7.

The hold-down device 43 for the sewn item 11 comprises a left hold-down element 44 and a right hold-down element 45, which are disposed in mirror symmetry with respect to one another, and form between themselves the above-mentioned recess 46. This recess 46 has a T-shaped profile, and corresponds essentially to the shape of the bar tack, as well as to the recess 24 in the upper blade 3 according to FIG. 5.

The hold-down device 43 further includes a sewing clamp rear part 8 and sewing clamps 9, 9*a*, as shown in FIGS. 9 and 1.

Disposed on each sewing clamp 9, 9*a*is a leaf spring 10, which rests with its front, free, flexible end on the sewn item 11 and presses it against the top side of the upper blade 3.

The position shown in FIG. 1 is the cutting position of the two blades 3, 5. In other words, a thread chain 12 is cut off of the sewn item 11. This thread chain extends through a suction opening 14 in the needle plate 1, beneath which a suction pipe 13 is disposed, where a vacuum is present.

Figure 3:
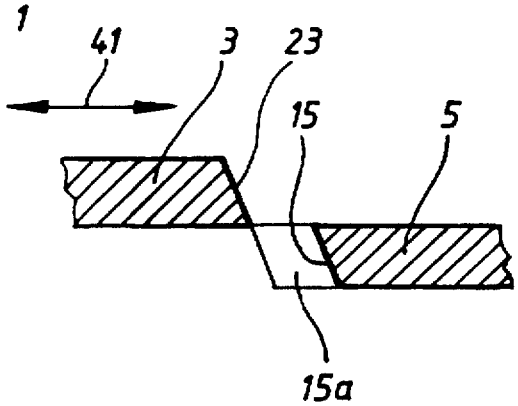
FIG. 3: a section through the upper and lower blades of FIGS. 1 and 2 in the non-cutting position.

As can be seen from FIGS. 2 and 3, the cutting edge 15 of the lower blade is somewhat arc-shaped, and is disposed in part 5*a* of the lower blade 5. The purpose served by this arc-shaped configuration of the cutting edge 15 of the lower blade 5 is that the suction opening 14 in the needle plate 1 is kept free, and is not covered by the lower blade.

According to FIG. 3, the upper blade 3 is displaceably driven in the arrow direction 41; however—once it is fixedly connected to the transport plate 2—it is also configured to be displaceable in the transverse direction, that is, in the arrow direction 42.

An approximately rectangular recess 22 is disposed in the sewn item stop 20 to assure a free space for the hold-down device 43, so that the corresponding sewing clamps 9, 9*a* can come in contact with the sewn item 11 from above.

The cutting edge 23 of the upper blade is approximately arc-shaped according to FIG. 5, and essentially extends in semicircular fashion around the suction opening 14 in order to keep the opening free and bring sufficient suction air to the suction opening 14 in the needle plate 1.

For cutting the plate after the sewing has been completed, the transport plate, carrying the upper blade with it, moves in the longitudinal direction as indicated by arrow 41 (FIGS. 3–5) toward the cutting edge of the lower blade (see FIG. 2). In this manner, the cutting edge 23 of the upper blade assumes a cutting position with respect to cutting edge 15 of the lower blade. In this way, the thread is cut off and carried away by the suction pipe 13 (see FIG. 1).

According to FIG. 5, the semicircular cutting edge 23 thus limits the recess 24 in the upper blade toward the front in the sewing direction, and thereby forms a recess 48 that is intended to ensure that the suction opening 14 in the needle plate remains free.

In another embodiment—shown as an alternative in dashed lines—the cutting edge of the upper blade 23*a* can also be configured as a straight line, in which case the recess 48 is omitted.

It is only important that the cutting edge of the upper blade 23, 23*a* always limit the entire recess 24 from the upper blade toward the front.

The limitation can be effected by a semicircular, straight, or any other shape.

FIG. 5 shows an approximately T-shaped recess 24 that essentially comprises a longitudinal recess 26 and a transverse recess 27 that extends into the longitudinal recess 26.

The two recesses 26, 27 therefore form the T-shaped recess which, according to the invention, permits the application of both a longitudinal bar tack 29 and a crossbar 28.

It is important for the cited bar tacks 28, 29 to be applied for finishing the hem of the sewn item 11, and for a thread chain hanging on the item to be fixed by the bar tacks and reliably cut off by the cutting device of the invention.

Figure 6:
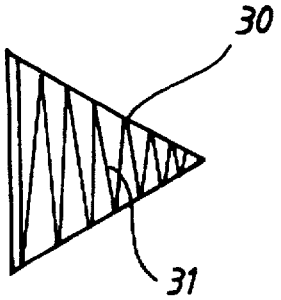
FIG. 6: a modified embodiment of a recess in the upper blade.
Figure 7:
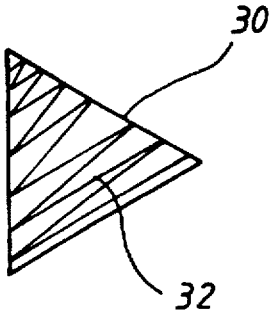
FIG. 7: a further option of configuring a recess, with an illustration of a different bar tack shape.
Figure 8:
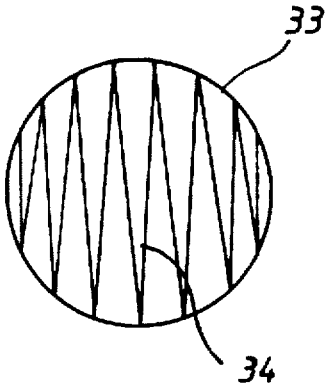
FIG. 8: a third embodiment of a recess in the upper blade.

FIGS. 6 through 8 show modifications of the subject of the invention. It can be seen that other recesses can be used in place of the T-profile recess 24. FIGS. 6 and 7 show that the recess 30 can have a triangular profile, and either a triangular bar tack 31 or a transversely-extending triangular bar tack 32 can be applied.

FIG. 8 shows a round recess 33, in which it can be seen that an approximately round sewing bar tack 34 can be applied.

It is crucial that the respective shape of the recess 24, 30, 33 should also essentially correspond to the respective shape of the recess 46, because the two recesses 24, 30, 33 should be similar in comparison to the recess 46 so that the sewn item can be reliably clamped by the hold-down device 43.

This assures reliable sewing.

FIG. 4 shows a modification of the present invention in which a pivoting and lifting device 35 is provided for the suction pipe 13. It is provided that a fixed part 38, which is connected in a hinged manner to a hinge part 37, is provided beneath the stationary needle plate 1. This hinge part 37 is able to pivot the suction pipe 13 about an axis in the plane of projection in FIG. 4.

A holding element 36 that surrounds the suction pipe 13 is further provided on the movable part of the pivoting and lifting device 35. A piston-cylinder arrangement is disposed in the pivoting and lifting device 35, with the piston rod 40 driving the movable part with the holding element 36.

Also provided is a latching apparatus 39 having a spring-loaded ball. This apparatus ensures that the above-mentioned pivoting and lifting device, when in the illustrated latched position in FIG. 4, selectively holds the suction pipe 13 in the suction position beneath the suction opening 14, and, in a different pivoting position, removes the suction pipe 13 from the suction opening 14 in a spring-loaded manner.

The pivoted-out position of the suction pipe is necessary approach toward the shuttle spool.

FIG. 9 also shows that screws 47, with which the leaf springs 10 (which are provided in pairs) are fixed, are provided on the hold-down device 43, more specifically on the respective sewing clamp foot 9, 9*a*.

Figure 10A:
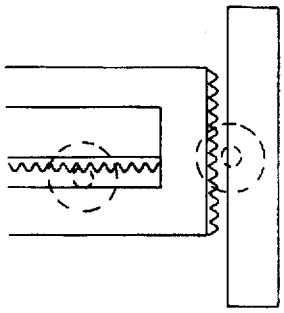
FIG. 10*a*: a schematic representation of conventional sliding carriages equipped with conventional toothed belts for driving the transport plate.
Figure 10B:
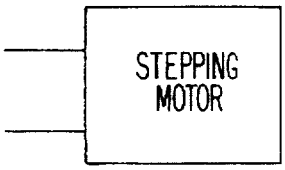
FIG. 10*b*: a schematic representation of a conventional stepping motor for driving the transport plate.
Figure 10C:
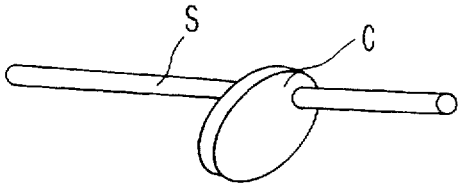
FIG. 10*c*: a schematic representation of a conventional spindle drive and cam plate for driving the transport plate.

FIG. 10*a* is a schematic representation of conventional sliding carriages equipped with conventional toothed belts for driving the transport plate, while FIGS. 1O*b*–10*c* are a schematic representations of: a conventional stepping motor, and a conventional spindle drive and cam plate for driving the transport plate, respectively.

An essential feature of the present invention, therefore, is that the seam does not unravel at the beginning or end of the sewn item, and can be tacked with a number of stitches determined by the bar tack length. The protruding thread chain used for finishing the seam is subsequently cut off with the cutting device of the invention.

Therefore, it is now possible for the first time to apply practically arbitrary bar tack arrangements, and reliably cut off thread chains hanging from them, with the technical teaching of the invention.

I claim:

1. An apparatus for automatically cutting off thread formations in sewing machines having a longitudinal direction and a transverse direction and comprising:

a needle plate having a surface defining a support plane;

a transport plate disposed adjacent the needle plate, the transport plate being displaceable in a plane parallel to the support plane in both the longitudinal direction and the transverse direction;

a cutting device disposed adjacent the needle plate for cutting off a thread formation from the sewn item, the cutting device including a stationary lower blade connected to the needle plate and an upper blade connected to the transport plate, the upper blade defining a first recess therein; and a hold-down device disposed adjacent the needle plate and defining a second recess therein and being configured for holding down a sewn item on the needle plate.

2. The apparatus according to claim 1, wherein the first recess is one of T-shaped, triangular, round and oval-shaped.

3. The apparatus according to claim 1, wherein the first recess has a cutting edge which defines a shape thereof.

4. The apparatus according to claim 3, wherein the cutting edge is straight.

5. The apparatus according to claim 3, wherein the lower blade has an arcuate cutting edge.

6. The apparatus according to claim 1, further comprising sliding carriages supporting the transport plate thereon.

7. The apparatus according to claim 1, further comprising a drive operatively connected to the transport plate, the drive including one of stepping motors, toothed belts, spindle drives and cam plates.

8. The apparatus according to claim 1, further comprising a suction device disposed below the needle plate for suctioning the thread formation.

9. The apparatus according to claim 8, wherein the suction device includes a suction pipe pivotable about an axis parallel to a longitudinal axis thereof.

10. The apparatus according to claim 9, wherein the suction pipe is adjustable in a direction of its longitudinal axis.

* * * * *